US005823447A

United States Patent [19]

Maybach

[11] Patent Number: 5,823,447

[45] **Date of Patent: *Oct. 20, 1998**

[54] ANGLED FAN NOZZLE AND UNIBODY CYLINDER

[75] Inventor: Christopher Peter Maybach, Parker, Colo.

[73] Assignee: Meritech, Inc., Englewood, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 703,905

[22] Filed: Aug. 27, 1996

[51] Int. Cl.[6] ..... B05B 1/00

[52] U.S. Cl. ..... 239/596; 239/597; 239/601

[58] Field of Search ..... 239/596, 597, 239/533.14, 601, DIG. 1, 599

[56] References Cited

U.S. PATENT DOCUMENTS

| | | | |
|---|---|---|---|
| 2,325,008 | 7/1943 | Gruett | 239/597 |
| 2,522,928 | 9/1950 | Carroll | 239/597 |
| 2,647,801 | 8/1953 | Lycan | 239/597 |
| 3,081,471 | 3/1963 | Newel | 15/21 |
| 3,220,424 | 11/1965 | Nelson | 134/47 |
| 3,437,274 | 4/1969 | Apri | 239/601 |
| 3,529,774 | 9/1970 | Apri | 239/596 |
| 3,647,147 | 3/1972 | Cook | 239/601 |
| 3,699,984 | 10/1972 | Davis | 134/95 |
| 3,757,806 | 9/1973 | Bhaskar et al. | 134/191 |
| 3,844,278 | 10/1974 | Weider | 128/66 |
| 3,918,987 | 11/1975 | Kopfer | 134/95 |
| 4,020,856 | 5/1977 | Masterson | 132/74.5 |
| 4,219,367 | 8/1980 | Cary, Jr. et al. | 134/29 |
| 4,402,331 | 9/1983 | Taldo et al. | 134/58 R |
| 4,688,585 | 8/1987 | Vetter | 134/56 R |
| 4,817,651 | 4/1989 | Crisp et al. | 134/18 |
| 4,925,495 | 5/1990 | Crisp et al. | 134/102 |
| 4,942,631 | 7/1990 | Rosa | 4/623 |
| 5,265,628 | 11/1993 | Sage et al. | 134/58 R |

OTHER PUBLICATIONS

"Maximum™ Automatic Glove Waqsher", Dryden Engineering Company, Inc., 3350 Scott Blvd., #18, Santa Clars, CA 95054, Glove Washer Data Sheets (no date given).

*Primary Examiner*—Andres Kashnikow
*Assistant Examiner*—Lisa Ann Douglas
*Attorney, Agent, or Firm*—Rick Martin

[57] ABSTRACT

A fan pattern nozzle has an inlet groove on its inlet surface along a radius to a single edge of its perimeter. The water enters the orifice via this inlet groove. The water picks up a momentum which results in an exit deflection angle of about 15° out the outlet groove. This nozzle enables the construction of an injection molded unibody washing cylinder having a maximum wall thickness of ¼ inch. A plurality of nozzle mounting holes are canted at 15° down toward the bottom of the washing cylinder. When the nozzles are installed in the mounting holes, the resulting fan patterns are canted 30° toward the bottom of the washing cylinder, thereby improving the cleansing operation and minimizing the splashout. Washing embodiments include hand and glove, small parts, feet, whole body and cars.

3 Claims, 16 Drawing Sheets

ANGLED FAN NOZZLE AND UNIBODY CYLINDER

FIELD OF INVENTION

The present invention relates to a fluid nozzle that deflects a fan pattern at an acute angle from its output surface and a rotating washing cylinder having a unibody construction and a plurality of the deflecting nozzles.

BACKGROUND OF THE INVENTION

U.S. Pat. No. 5,265,628 (1993) to Sage et al. hereby incorporated herein by reference teaches a no-touch hand-washing system having a pair of rotating cylinders. Each cylinder has rotating nozzles that spray wash water on the user's hands. Through program control a purge, wash, dwell, rinse, self-clean, and an air dry cycle is provided.

Old Cylinder Functional Description

The Sage system consists of a pair of nested 7 inch diameter cylinders with one open end each. The outer cylinder is slightly larger in diameter than the inner cylinder, which allows the inner cylinder to be installed into the open end of the outer cylinder and then sealed with an O-ring. The net effect is a device which will accept an object to be washed introduced into the open end of the nested pair. Pressurized cleaning fluid is introduced into the closed end of the device. This fluid then flows into the clearance space between the inner and outer cylinders until the space is completely filled. The fluid is then forced out of the spray nozzles located in the wall of the inner cylinder and dispensed onto the object to be washed. The entire cylinder assembly is rotated around its longitudinal axis which allows the spray nozzles to wash the entire surface of the object. The spray nozzles in the inner cylinder consist of 19 orifices arranged in three major groupings; four in the closed end and oriented facing out toward the open end, seven in the cylinder wall in a helical pattern with a 30° cant down toward the closed end of the cylinder, and eight nozzles grouped circumferentially near the open end of the cylinder also with a 30° cant down toward the closed end. The 30° cant of the above mentioned nozzles provides for imparted momentum to the cleansing fluid which will carry the fluid flow down to the closed end of the cylinder where it is allowed to exit the cylinder via drain slots. Also, it is imperative to minimize the water splashing out of the open end of the cylinder because of safety hazards and environmental pollution. Therefore, the 30° cant is a key design requirement of the nozzle. The clockwise rotation of the complete cylinder generates a screw effect from the helically arranged nozzles which will tend to remove debris from the object to be washed beginning at the end of the object closest to the open end of the cylinder and wash it off down toward the drain slots.

Speed of cylinder rotation, pressure of cleaning fluid, temperature of cleaning fluid and duration of wash cycle can all be manipulated to optimize the cleanliness of the washed object.

Old Cylinder Construction Description

Inner Cylinder/Outer Cylinder/Complete Cylinder

The Sage inner cylinder consists of five major injection molded parts, 19 minor injection molded parts, eight threaded brass inserts and five rubber O-rings. The five major molded parts are the endcap, puck, two segment halves and the ring. The 19 minor molded parts are the nozzles. They are conventional 90° fan pattern nozzles. The endcap and puck together constitute the lower ⅓ of the inner cylinder and contain the four closed end nozzles, the drain holes and the brass inserts for assembling the inner to the outer cylinder. The inserts are ultrasonically welded into the endcap. The two segment halves contain the seven helical nozzles and the slanted annular ring geometry to achieve the 30° cant to the spray pattern. The ring contains the eight circumferential nozzles and the slanted annular ring geometry to achieve the 30° cant to the spray pattern.

The outer cylinder consists of two major injection molded parts, three machined plastic parts, a ball bearing and three set screws. The two major molded parts are the barrel and the endcap. The three machined parts are the shaft, lock collar and seal spacer. The endcap contains the drain holes, mounting holes and houses the shaft, lock collar, bearing, and seal spacer which permit the rotation of the cylinder while supplying pressurized cleaning fluid. The barrel and endcap, when glued together, form the pressure vessel for fluid containment.

Each of the major molded parts in both the inner and outer cylinder are assembled in a snap fit and then glued together. All seams between glued parts must be water-tight to prevent pressure leaks. The nozzle receiving holes in the inner cylinders are machined in post-molding. Regarding the inner cylinder, the part geometry of the drain holes, as well as the 30° nozzle cant, preclude the possibility of injection molding the part in one piece as the core of the tool would be captured by the part. This dictates by design that the part is low volume and expensive costing about $125 per inner cylinder. Injection molding plastic is the only way to feasibly manufacture the inner cylinder due to the necessary tolerances.

A plurality of annular rings each having a 30° angle allow conventional 90° nozzles to be mounted at a 30° angle and provide the necessary 30° fan spray pattern.

The present invention provides a cost saving apparatus having performance characteristics identical to the prior art inner cylinder and nozzles. A unibody inner cylinder is made possible having a smooth inner surface which enables one-piece injection molding of the inner cylinder. Only a maximum width of ¼ inch is feasible for the plastic inner cylinder wall. A nozzle is by necessity 0.120-inch thick. This makes the maximum tilt angle in the ¼ inch thick cylinder wall to be 15°. A new nozzle was invented to achieve the remaining 15° of deflection angle to achieve a 30° cant relative to the inner cylinder wall.

New Nozzle Functional Description

Due to the wall thickness limitations discussed earlier, it becomes necessary to design a nozzle which would lower splashout on the new cylinder design to an acceptable level (less than or equal to 0.2 grams of water per 12-second cycle at 15 p.s.i. cylinder pressure).

A search of existing off-the-shelf disc nozzles, and contacting application engineers in the field of nozzle design showed nothing available which would satisfy the requirements.

First a discussion of nozzle design theory. Basically a nozzle is a device which converts fluid pressure to fluid flow. The pattern of the flow is determined by nozzle geometry. At the orifice of the nozzle, the solid fluid stream is broken up into fine water droplets and dispensed. The nozzle used in the Sage cylinder produced a flat fan pattern spray of about 70° included angle and 1/16 inch thick. This pattern was projected at a 90° angle to the flat disc surface (0° angle of deflection). The nozzle designed for the new cylinders also produces a flat fan pattern of about 70° included angle and 1/16 inch thick. However, this pattern is projected at a 75° angle to the flat disc surface (15° angle of deflection). To achieve this 15° angle of deflection, it was necessary to alter the geometry of the nozzle. A disc nozzle is basically a flat circular piece of material (plastic or metallic). In cross section, the profile would be a hat section, a large diameter base with a smaller diameter protruding shoulder centered on it. The base is ½ inch diameter and 0.060 inch thick, the shoulder is ⅜ inch diameter and 0.060 inch thick. This makes the height of the hat section 0.120 inch tall. The flow of liquid through the nozzle is in from the large diameter surface and exiting, in the fan pattern, from the ⅜ inch diameter surface. See FIG. 3.

Into the flat surfaces of each side of the nozzle is a groove, cut into the body of the nozzle. The groove on the outlet side of the nozzle is formed by a 0.032 inch thick, ½ inch diameter cutting wheel, the cutting wheel is brought down perpendicular to the nozzle surface and centered on same. The groove is cut to a depth of 0.060 inch at the center forming an arc-shaped groove. The groove on the inlet side of the nozzle is oriented 90° opposed to the groove on the outlet side and cut with the same cutter as outlet groove to 0.060 inch depth. The orifice is formed by the intersection of the two grooves and is a square profile 0.032 inch on edge. This geometry will produce a 0° deflection angle. In order to produce the 15° deflection angle, the groove on the inlet side of the nozzle is ½ the length of the standard nozzle. It extends from the center, at the orifice, out to the edge of the nozzle perimeter. This forces all the fluid entering the orifice to enter from one direction only (the direction of the groove) rather than entering from two directions as in the standard nozzle. The inlet fluid on the modified nozzle has a net momentum when it enters the orifice in contrast to the standard nozzle in which the fluid flow from both directions effectively cancel each other out. This net momentum of the fluid in the modified nozzle design forces the fan pattern to be deflected approximately 15° away from the inlet side groove.

By using the new 90° nozzles, a unibody inner cylinder is made feasible at a cost of $25 versus the multi-piece prior art version cost of $125. Thus, the present invention dramatically simplifies and reduces the cost of manufacturing a rotating cylinder having nozzles. Additionally new applications are opened up by cost reduction using the new nozzles.

SUMMARY OF THE INVENTION

The main object of the present invention is to provide a fan nozzle having an acute angle of deflection.

Another aspect of the present invention is to provide a unibody injection molded rotating cylinder capable of mounting the improved nozzles to provide a 30° angle of deflection relative to the inner wall of the cylinder.

Other objects of this invention will appear from the following description and appended claims, reference being made to the accompanying drawings forming a part of this specification wherein like reference characters designate corresponding parts in the several views.

New Cylinder Functional Description

Each cylinder consists of a pair of nested approximately 7 inch diameter cylinders with one open end each. The outer cylinder is slightly larger in diameter than the inner cylinder which allows the inner cylinder to be installed into the open end of the outer cylinder and then sealed with O-rings. The net effect is a device which will accept an object to be washed into the open end of the nested pair. Pressurized cleaning fluid is introduced into the closed end of the device. This fluid then flows into the clearance space between the inner and outer cylinders until the space is completely filled with fluid, this fluid is then forced out through the spray nozzles located in the wall of the inner cylinder and dispensed onto the object to be washed. The entire cylinder assembly is rotated around its longitudinal axis which allows the spray nozzles to wash the entire surface of the object. The spray nozzles in the inner cylinder consist of 20 independent orifices arranged in three major groupings; four in the closed end oriented facing out towards the open end, eight nozzles located in the cylinder wall in a helical pattern with a 30° cant toward the closed end of the cylinder and eight nozzles grouped circumferentially near the open end also with a 30° cant toward the closed end of the cylinder. The 30° cant of the nozzle spray pattern at the above mentioned locations provides for imparted momentum to the cleansing fluid which will carry the fluid down to the closed end of the cylinder where it is allowed to exit the cylinder via drain holes. The clockwise rotation of the entire cylinder assembly generates a screw effect to the helically arranged nozzles which will tend to remove debris from the object to be washed beginning at the end of the object closest to the open end of the cylinder and wash it off down towards the drain holes.

Speed of cylinder rotation, pressure of cleaning fluid, temperature of cleaning fluid, and duration of wash cycle can all be manipulated to optimize the cleanliness of the washed object.

New Cylinder Construction Description

Inner Cylinder/Outer Cylinder/Complete Cylinder

The inner cylinder consists of one major injection molded part, 20 nozzles, four O-rings and three brass inserts. The molded part forms the entire geometry of the inner cylinder with no post-molding labor. The nozzles snap fit into the mold without any gluing required. The brass inserts thread into the mold without ultrasonic welding.

The nozzles are unique to this cylinder design. In order to mold the cylinder in one piece, it was required that the interior surface of the part be smooth walled to allow tool release. Additionally, the maximum wall thickness allowed for this type of injection molded part is ¼ inch. These two factors combined would allow only a 15° cant to the nozzle receiving socket in the cylinder wall. Any angle greater than 15° would force the counterbored receiving socket to break out into the interior surface of the cylinder. This situation requires the use of this unique nozzle design which will generate an additional 15° angle to the spray pattern by itself. When this nozzle is installed in the 15° receiving socket, the total spray angle is brought up to 30°. The 30° angle is required to keep splashout down to an acceptable level. Splashout is defined as the amount of the cleaning fluid which is allowed to escape out the open end of the cylinder during the wash cycle. This splashout comes from two major sources. The four nozzles located in the closed end of the cylinder spray, largely, directly out the open end of the cylinder. The fluid from the nozzles in the helical and circumferential pattern is responsible for stopping the momentum of the fluid from the four closed-end nozzles before it can get out of the open end and the greater the downward angle of this interference spray, the greater percentage of the splashout is canceled. The second contributor to splashout is the fluid from the helical and circumferential group of nozzles striking the object to be washed and being reflected back towards the open end of the cylinder. The most effective way to minimize this splashout, without the use of a physical, cuff style barrier which presents cross contamination potential, is by increasing the downward cant angle of these nozzles thereby forcing a greater momentum change in the water to escape out of the open end of the cylinder. The 15° angle of the as-molded part was insufficient by itself in decreasing splashout to an acceptable level, particularly in a clean-room environment. It was necessary, therefore, to develop a nozzle which would impart an additional angle to the spray pattern. A description of this nozzle design is included later in this discussion.

The inner cylinder has molded-in provisions for the installation of a brush in the closed end. The brush allows for a more aggressive, friction-based removal of debris from the object to be washed, fingernails on a hand, for example. The brush rotates with the cylinder and is, therefore, effective at debris removal, even when the object is stationary in the cylinder. The spray action of the nozzles will automatically clean the brush bristles during operation of the cylinder.

The inner cylinder has molded in provisions for the installation of extensions which increase the depth of the cylinder to be able to wash long objects. There is no maximum depth limitations by design. The length of the extension can be custom designed to accommodate the object(s) length.

The complete cylinder is assembled with three stainless steel screws to secure the inner to the outer cylinder. There are no moving parts in the complete assembly, unlike the older design.

The cylinder is designed to meet the cleanability requirements of the National Sanitation Foundation, something which was not possible with the older design.

Small Parts Washer Cylinder

The cylinder design is currently around 7 inches in diameter. It is sized this way to optimize the washing of human hands. This cylinder is also able to be used as a small parts washer e.g. jewelry. The system would consist of the cylinder, a motor and drive belt to rotate the cylinders, a housing to support the cylinder and motor and collect the drain fluid, a cleaning fluid inlet, a control system, and a platform on which to place the parts to be washed.

The parts to be washed are placed on the platform which is then lowered into the cylinder. The start button is pressed which activates the motor, flow control valve, and pump. The cleaning fluid is drawn from the reservoir by the pump, pressurized and pumped into the piping system. The flow control valve, when open, allows fluid flow up into the cylinder inlet where it enters the cylinders. The fluid exits the cylinder through the 20 spray nozzles where it is dispensed onto the object to be washed. The fluid then flows down and out the drain holes in the bottom of the cylinder where it is collected in the housing and funneled out the drain tube to the reservoir where it is collected, filtered, and available for reuse by the pump.

Glove Washer

The cylinder could be sized and housed appropriately to serve as a glove washer. There is a need for glove washing ranging from sterilization of vinyl and latex gloves in the medical industry, to particle removal on polyurethane and Teflon® gloves in the cleanroom industry to debris and bacteria removal from the chain mesh safety gloves common in the food processing arena.

The unit would consist of a pair of cylinders, a drive mechanism, a fluid piping and control system, and a housing to contain all the parts.

Functioning would be as follows:

The gloved hands trip a photoelectric sensor as they are inserted into the cylinders.

The sensor activates the control module which opens the water flow control valve and starts the motor to rotate the cylinders.

The water is mixed with a chemical (soap, surfactant, etc.) at the chemical injector (venturi device).

This mixture is routed to the two cylinder inlets, fills the cylinders and sprays onto the gloves through the spray nozzles.

The fluid cleans the gloves and is collected by the housing where it is funneled to the drain.

Foot Washer

The cylinders could be sized and housed appropriately to serve as a foot washer for people. The unit would consist of the cylinders, drive mechanism, the fluid piping and control system, and the housing to contain all the components and collect and drain the fluid.

The unit would function as follows:

The person sits in the chair, places their feet onto the perforated foot platform (to allow washing of the soles of the feet).

The unit can be activated by either foot pressure, an on/off switch or a photoelectric sensor.

When activated, the motor begins to rotate and the fluid flow control valve opens to allow the fluid to flow through the piping system where it can be mixed with soap or surfactants by the chemical injector.

Fluid flows through the cylinder inlets into the cylinders and is dispensed onto the feet through the spray nozzles.

Drain water is collected in the housing and funneled to the drain.

Possible markets for this device are podiatrists, health clubs, athletic teams and physical therapists.

Body Washer

The cylinder could be made large enough to wash objects much larger than hands such as complete bodies, automobiles or animal carcasses after slaughter and before processing.

A cylinder of hundreds of inches in diameter could be rotomolded. Nozzles of several inches in diameter would be injection molded. The mechanism required to perform the washing function would vary depending on the object to be washed. In the case of washing people or automobiles, the cylinder would be translated vertically down over the object while the object is stationary. Activation could be by pressure switch when the object is on the wash platform, an on/off switch, or a photoelectric sensor. In the case of a hanging carcass washer, the cylinder would be translated vertically up over the carcass from below. To save on mold and part costs on large diameter cylinders, the cylinder need not be solid wall. A helical arrangement of nozzles on an open frame could be motor driven to rotate around the object. Non-solid walls would also allow visual contact through the cylinder while it is in operation.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 1:
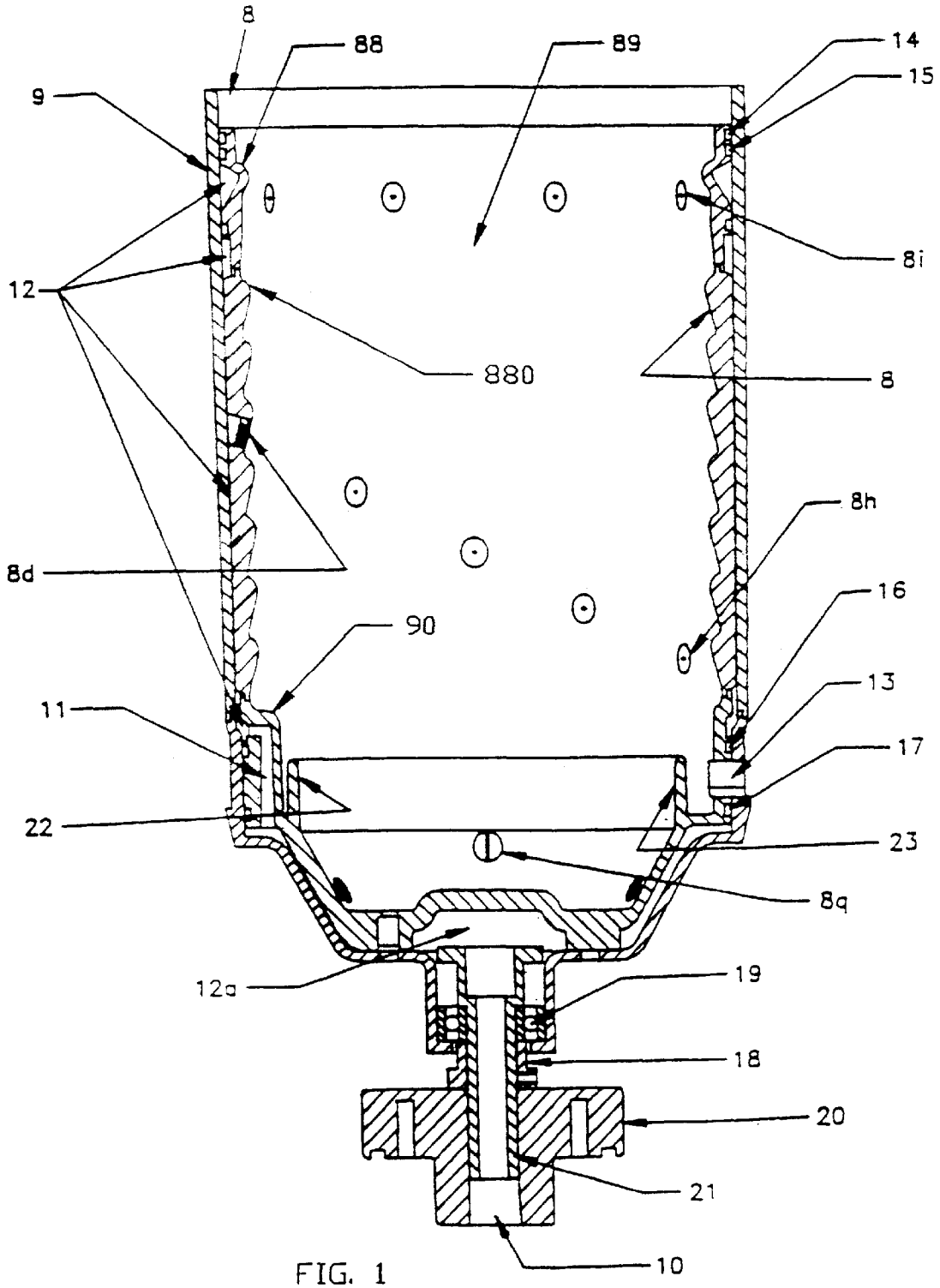
FIG. 1 PRIOR ART
FIG. 1 (prior art) is a cross sectional view of the Sage inner and outer cylinder assembly.
Figure 4:
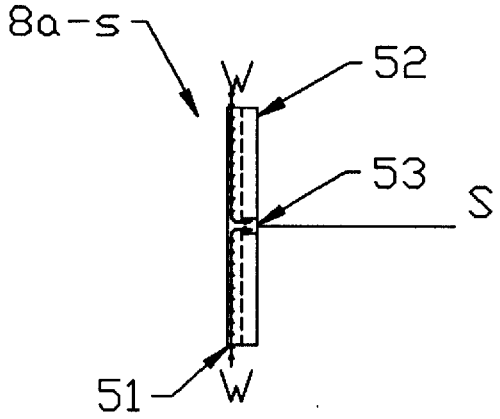
FIG. 4 (PRIOR ART)
FIG. 4 (prior art) is a side plan view of the nozzle shown in FIG. 3.

Referring first to FIG. 1 cylinder 8 is substantially the same as cylinder 17, FIG. 4 in U.S. Pat. No. 4,817,651 (1989) to Crisp et al., said patent being incorporated herein by reference. Rotating nozzles 8*a–s* are slits in the inner surface of rotating cylinder 8. Nozzles 8*a–g* form a helical pattern on the user's hand such that dirt is swept from the forearm to the fingertips.

Nozzles 8*h–o* form a water splash prevention ring around the user's forearm. Nozzles 8*p–s* are an improvement over U.S. Pat. No. 4,817,651. Nozzles 8*p–s* are fingertip cleaning nozzles.

Rotating cylinder 8 further comprises an outer cylinder 9 and an inner cylinder 9*o* having an inner wall 88. The inner wall 88 has annular rings 88*o* which are angled at 30°. Nozzle 8*d* can be seen mounted at a 30° angle from the normal of inner wall 88. All the nozzles are similarly mounted. Water inlet 10 feeds the washing and rinsing fluids through passage 11 into chamber 12, 12*a* into hand area 89 and out drain slots (s) 13. Drain protectors 22 and 23 prevent gloves or fingertips from reaching drain slot 13.

The sizing of chamber 12 is critical to proper operation. Chamber 12 holds approximately 150 milliliters of fluid. A full ten-second wash and rinse cycle uses approximately 1900 milliliters of fluid. The criticality of the ratio of 150/1900 (approximately 0.08) is to minimize the presence of washing agents in the rinse cycle. If the chamber 12 is too large, then soap remains in the rinse water because the rinse cycle only lasts seven seconds or less.

Fluid is retained in chamber 12 by means of O-ring grooves 14, 15, 19, and 17. Inlet water travels from inlet 10 to chamber 12*a*. The water is contained therein by means of cylinder lock collar 18, cylinder bearing 19, cylinder mount 20, and cylinder shaft 21. Cylinder lock collar 18, cylinder mount 20 and cylinder shaft 21 remain fixed while rotating cylinder 8 rotates.

The rotating cylinder 8 is snap mounted and easily removed for maintenance from cylinder mount 20.

Figure 2:
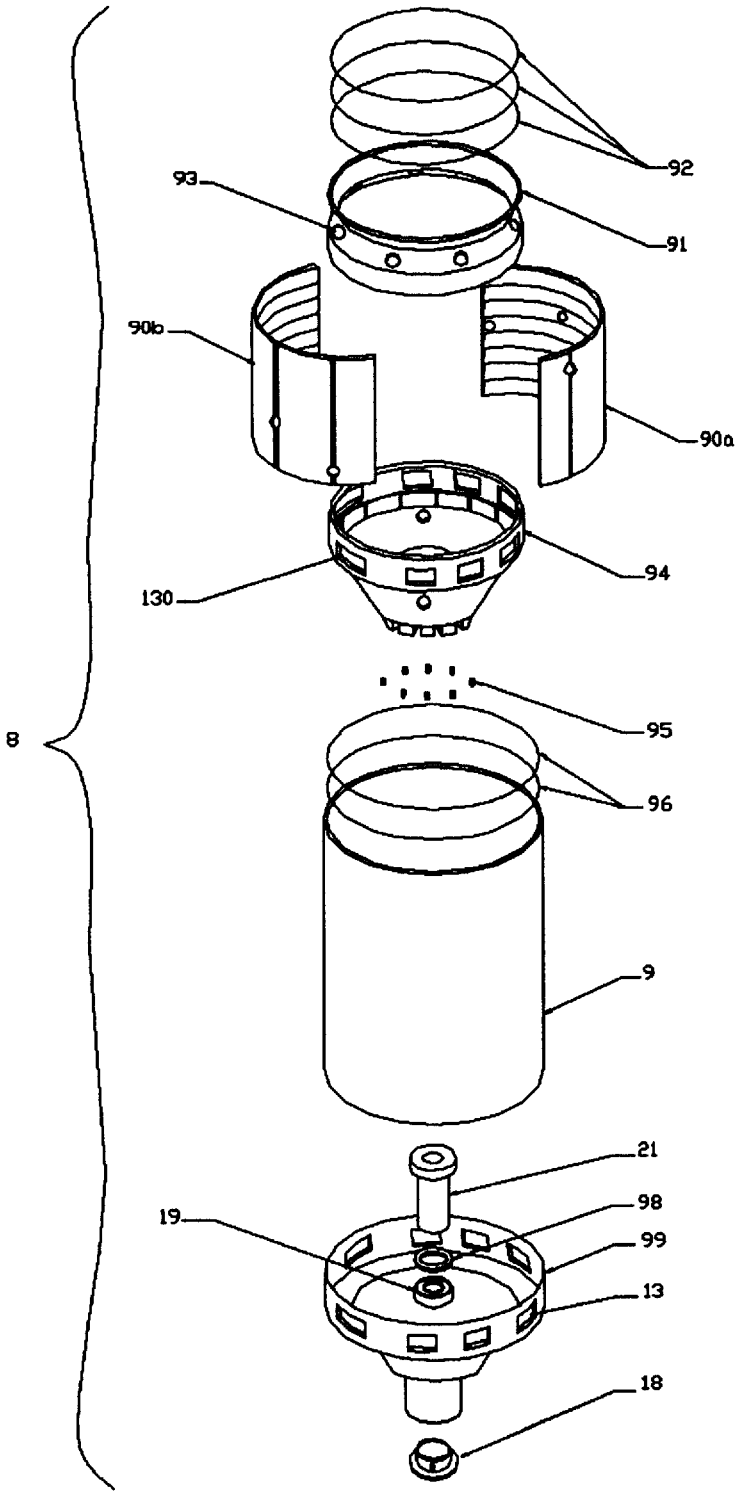
FIG. 2 PRIOR ART
FIG. 2 (prior art) is an exploded view of the Sage assembly shown in FIG. 1.

Referring next to FIG. 2 the cylinder 8 is shown in a fully exploded detailed manufactured parts view. The outer cylinder 9 is made in one piece. It mounts to outer endcap 99 having drain holes 13 which provide draining through the inner endcap 94 having drain holes 130 via space 12, 12*a* as shown in FIG. 1. The seal spacer 98 holds the shaft 21 off the bearing 19.

The inner cylinder 90 is made by injection molding halves 90*a* and 90*b*, then gluing the halves together and mounting them in inner endcap 94. Eight brass inserts 95 support the inner cylinder 90 in the outercap 99. O-rings 92, 96 prevent leakage out of space 12, 12*a*. The inner cap ring 91 secures the bottom of halves 91*a*, 90*b*. Nineteen nozzle mounting holes 93 support the 90° nozzles 8*a–s* as shown in FIG. 1.

In summary, there are five major injected molded parts for the assembly. They are the inner cylinder halves 90*a*, 90*b*, the inner endcap 94, the puck 97, and the inner cap ring 91.

Figure 3:
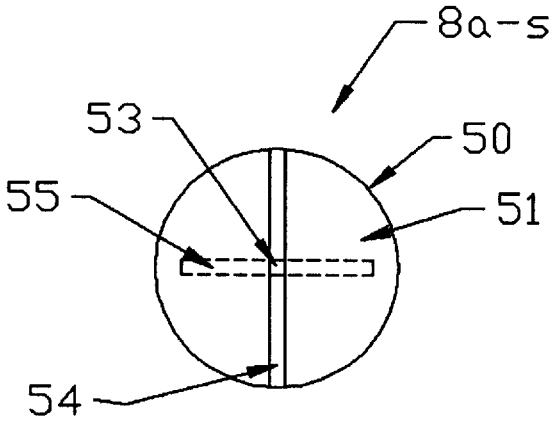
FIG. 3 (PRIOR ART)
FIG. 3 (prior art) is a side plan view of the nozzle shown in FIG. 3.
Figure 5:
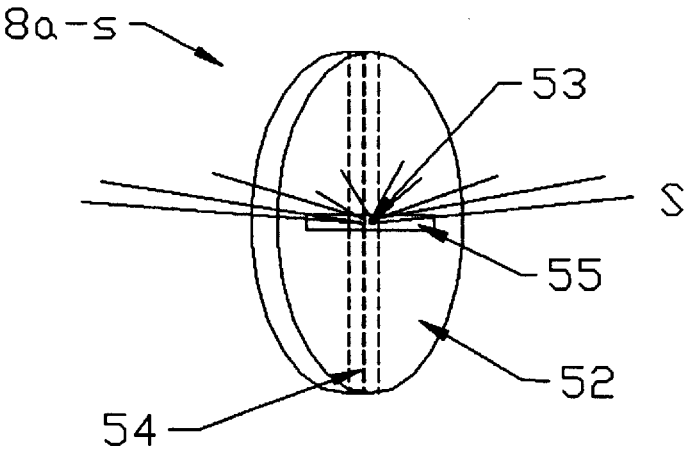
FIG. 5 (PRIOR ART)
FIG. 5 (prior art) is a perspective view of the nozzle shown in FIG. 3 with the spray pattern shown.

Referring next to FIGS. 3, 4, 5 the nozzles 8*a–s* are shown as all are identical 90° fan pattern nozzles A disc 50 is a single piece of plastic. It has an inlet surface 51 and an outlet surface 52. The water flow is shown by arrows W. The fan pattern S emanates out of orifice 53 which is made from an intersection at right angles of groove 54 which is full width on the inlet surface 51 and groove 55 on the outlet surface 52.

Figure 6:
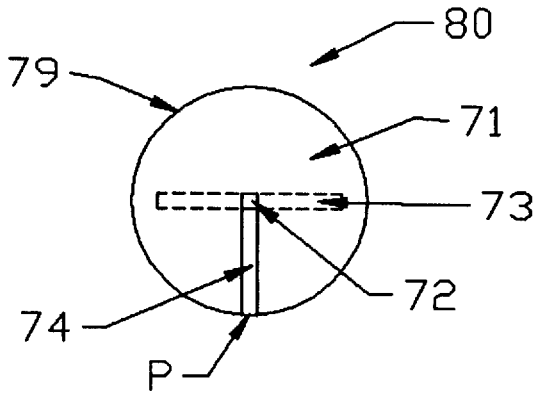
FIG. 6 is a back plan view (inlet side) of the preferred embodiment of the 15° deflected fan pattern nozzle.
Figure 7:
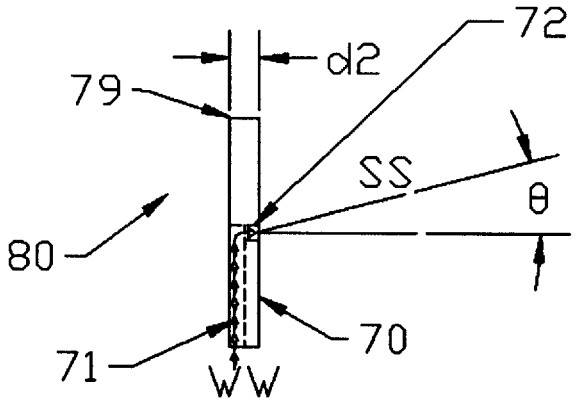
FIG. 7 is a side plan view of the nozzle shown in FIG. 6.
Figure 8:
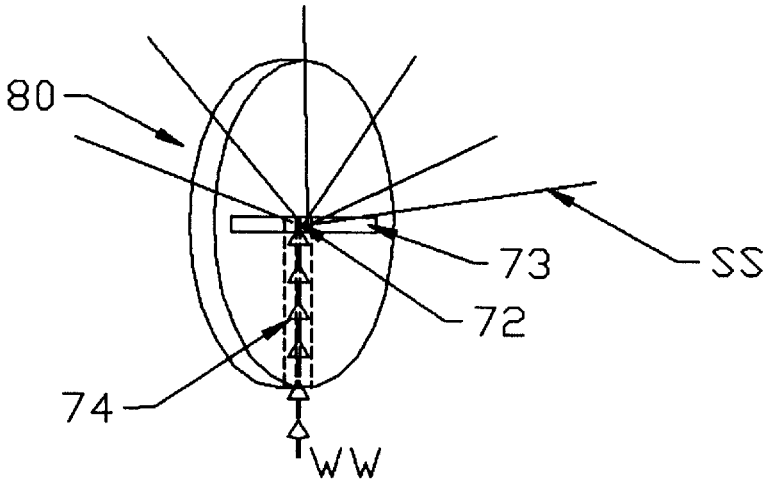
FIG. 8 is a perspective view of the nozzle shown in FIG. 6 showing the spray pattern.

Referring next to FIGS. 6, 7, 8 the deflection nozzle 80 is the preferred embodiment of the nozzle portion of the present invention. The unibody circular plastic base 79 has an inlet surface 71 and an outlet surface 70. The outlet surface 70 has a traditional groove 73 cut across the central orifice 72. The inlet surface 71 has a unique groove 74 cut at right angles to the outlet groove 73 and extending from the orifice 72 to the perimeter p of the base 79. The water travels along path WW and exits the orifice 72 at an acute angle θ of about 15° from the normal to the outlet surface. Unlike the counterbalancing forces of water entering from opposite directions as shown in FIG. 4, this nozzle provides for a unidirectional flow of inlet water through the orifice 72, thereby creating an off-center momentum of the exit fan pattern SS. The result is a fan pattern SS deflected at about 15° from the normal to the outlet surface 70.

Regarding nozzle flow rates, the old style nozzle shown in FIGS. 3, 4, 5 does not produce a deflected spray pattern. It is capable of flowing 0.12 gallons per minute of water at an operating pressure of 15 p.s.i. The flow rate of a fan pattern nozzle is a function of operating pressure and orifice diameter (or cross section if orifice is not round) That means at a given pressure, a larger orifice nozzle will flow more fluid than a smaller orifice nozzle. Likewise, for a given orifice diameter, a nozzle will flow more fluid at a high pressure than at low pressure.

Since the flow rate is dependent only on pressure and orifice for a given viscosity fluid, and since the new nozzle design shown in FIGS. 6, 7, 8 maintains the same orifice cross-section as the old nozzle then the flow rate for the new nozzles is also 0.12 g.p.m. of water at 15 p.s.i.

Figure 9:
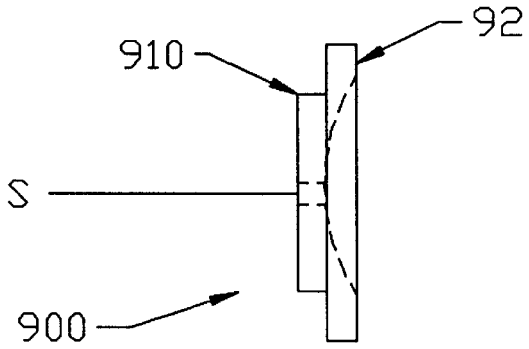
FIG. 9 (PRIOR ART)
FIG. 9 (prior art) is a side plan view of a conventional 90° nozzle having a snout design.
Figure 10:
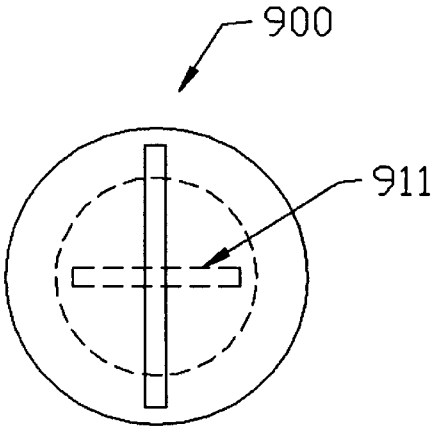
FIG. 10 (PRIOR ART)
FIG. 10 (prior art) is a front plan view of the nozzle shown in FIG. 9.

Referring next to FIGS. 9, 10 an alternate embodiment of a conventional 90° nozzle 900 is shown having a snout 910. All performance and groove characteristics are identical to the embodiment shown in FIGS. 3, 4, 5. The outlet groove 911 is built into the snout 910.

Figure 11:
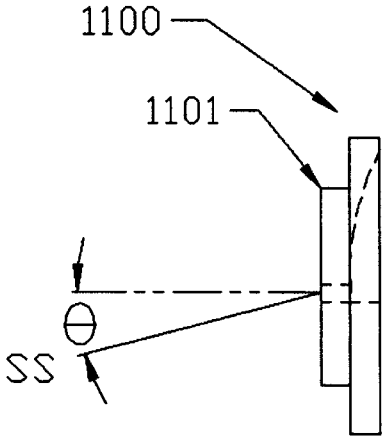
FIG. 11 is a side plan view of an alternate embodiment of the present invention having a snout.
Figure 12:
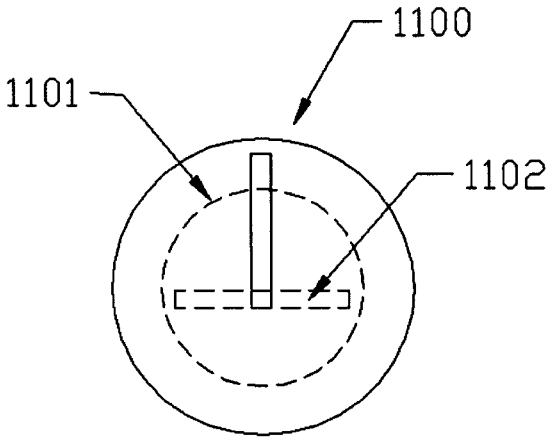
FIG. 12 is a front plan view of the nozzle shown in FIG. 11.

Referring next to FIGS. 11, 12 an alternate embodiment of the deflected nozzle is shown as nozzle 1100. It has the same performance and groove characteristics as the preferred embodiment shown in FIGS. 6, 7, 8. The snout 1101 has the outlet groove 1102 built into it.

Figure 13:
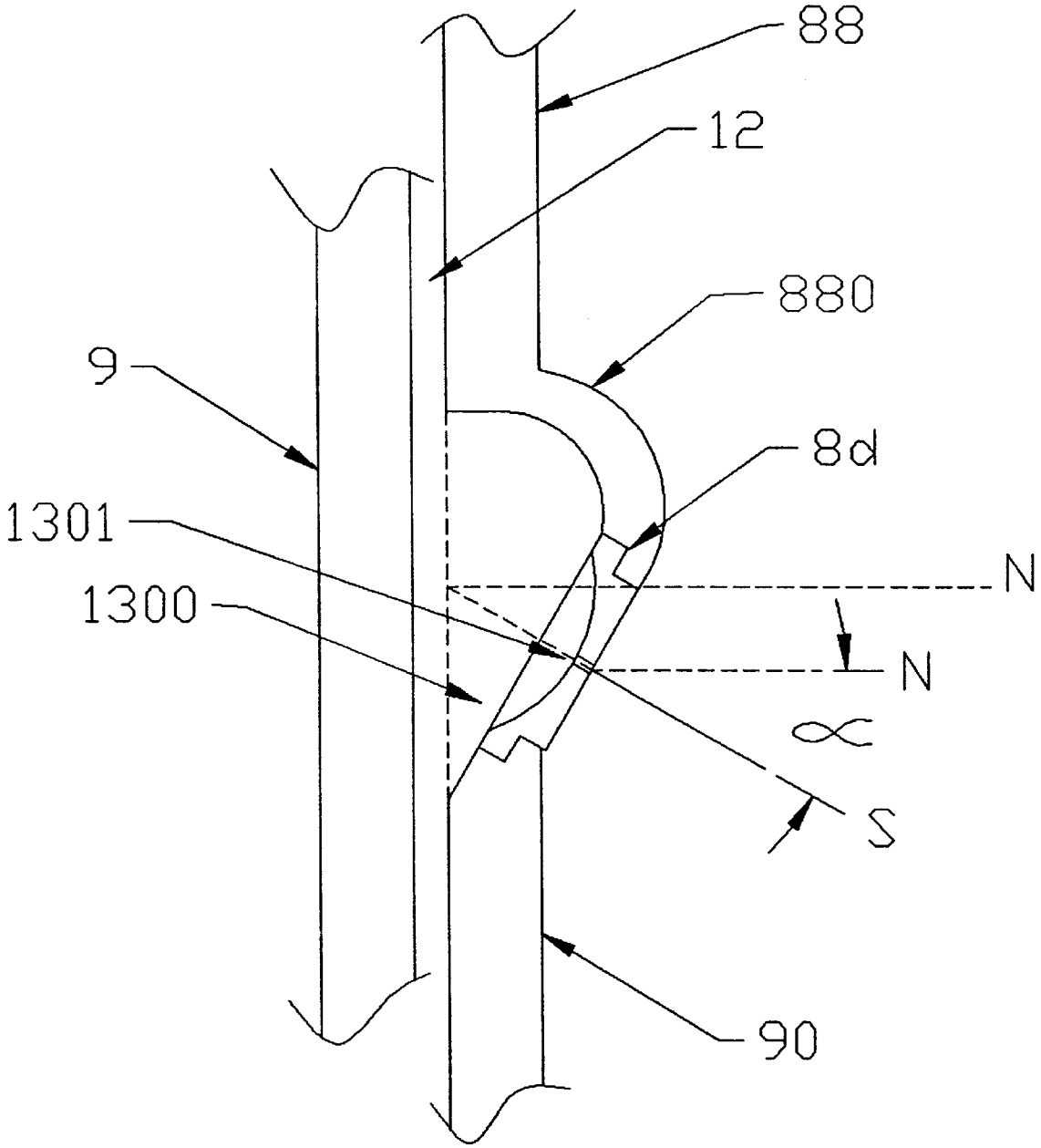
FIG. 13 (PRIOR ART)
FIG. 13 (prior art) is a sectional view of an inner cylinder having annular rings and a 90° nozzle mounted in the annular ring to result in a 30° angle of deflection of the fan pattern.

Referring next to FIG. 13 a cross sectional view of one annular ring 880 of FIG. 1 is shown. The annular ring 880 is built such that the hole 1300 has a central exit 1301 that intersects the inner wall 88 at angle $\alpha$ relative to a normal N. angle $\alpha$ is about 30°. When 90° nozzle 8*d* is mounted in hole 1300, the resulting fan pattern S exits at the angle $\alpha$ (15°) relative to a normal N to the inner wall 88.

Figure 14:
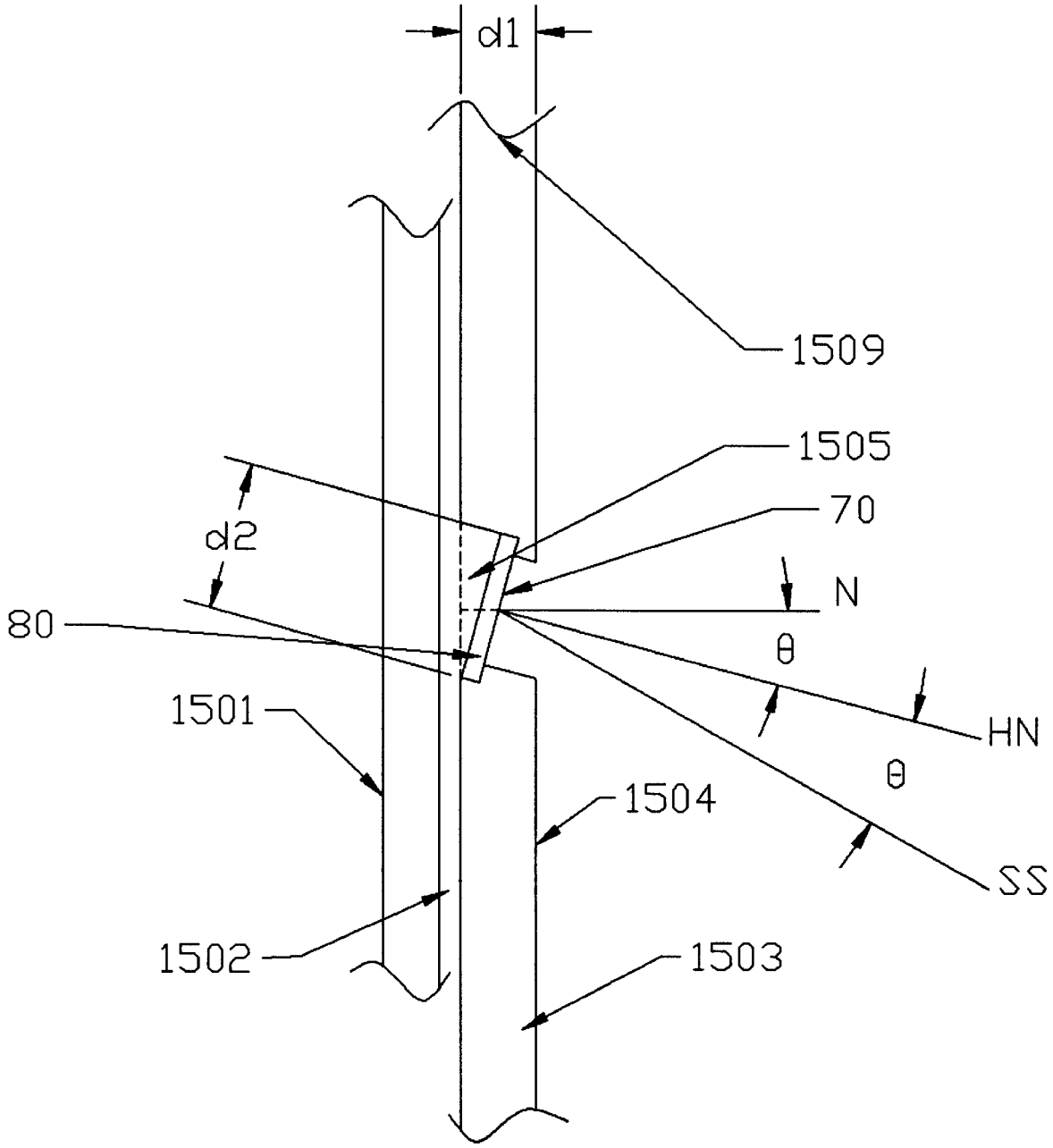
FIG. 14 is a sectional view of the preferred embodiment of the nozzle mounted in the preferred embodiment of the inner cylinder resulting in a 30° angle of deflection of the fan pattern.

Referring next to FIG. 14 the same deflection angle of 30° of the fan pattern SS relative to a normal N of the inner wall 1504 is accomplished with the deflected nozzle 80 having a deflection angle $\theta$ (see FIG. 7) of 15° relative to the normal HN from the outlet surface 70 of the nozzle 80. The nozzle 80 is mounted in the preferred embodiment of the inner cylinder 1503. The inner cylinder 1503 has a mounting hole 1505 canted at an angle $\theta$ of 15° relative to a normal N to the inner wall. Thus, the addition of the two 15° angles $\theta$ plus $\theta$ equals a 30° deflected fan pattern SS relative to the inner wall 1504. Space 1502 holds the washing fluid between the outer cylinder 1501 and inner cylinder 1503. Width $d_1$, of the inner cylinder wall 1509 can only be ¼ inch due to the limits of an injection molded part. Larger widths cause uneven cooling and out of spec tolerances. Since the diameter $d_2$ of the nozzle 80 is 0.500 inches, the nozzle hole 1505 is limited to a cant of angle $\theta$ of 15°. Any larger angle would destroy the smooth surface of inner wall 1504 by having the nozzle 80 protrude from it and intrude into space 1510. Such an intrusion would prevent a watertight seal between the nozzle 80 and the inner cylinder 1503. In summary the combination of the nozzle 80 with a cylinder wall 1509 having a width $d_1$ of ¼ inch provides a fan pattern deflection angle of 30° as w ell as a smooth inner wall 1504. The same deflection angle could be achieved on a non-rotating flat inner wall embodiment not shown.

Figure 15:
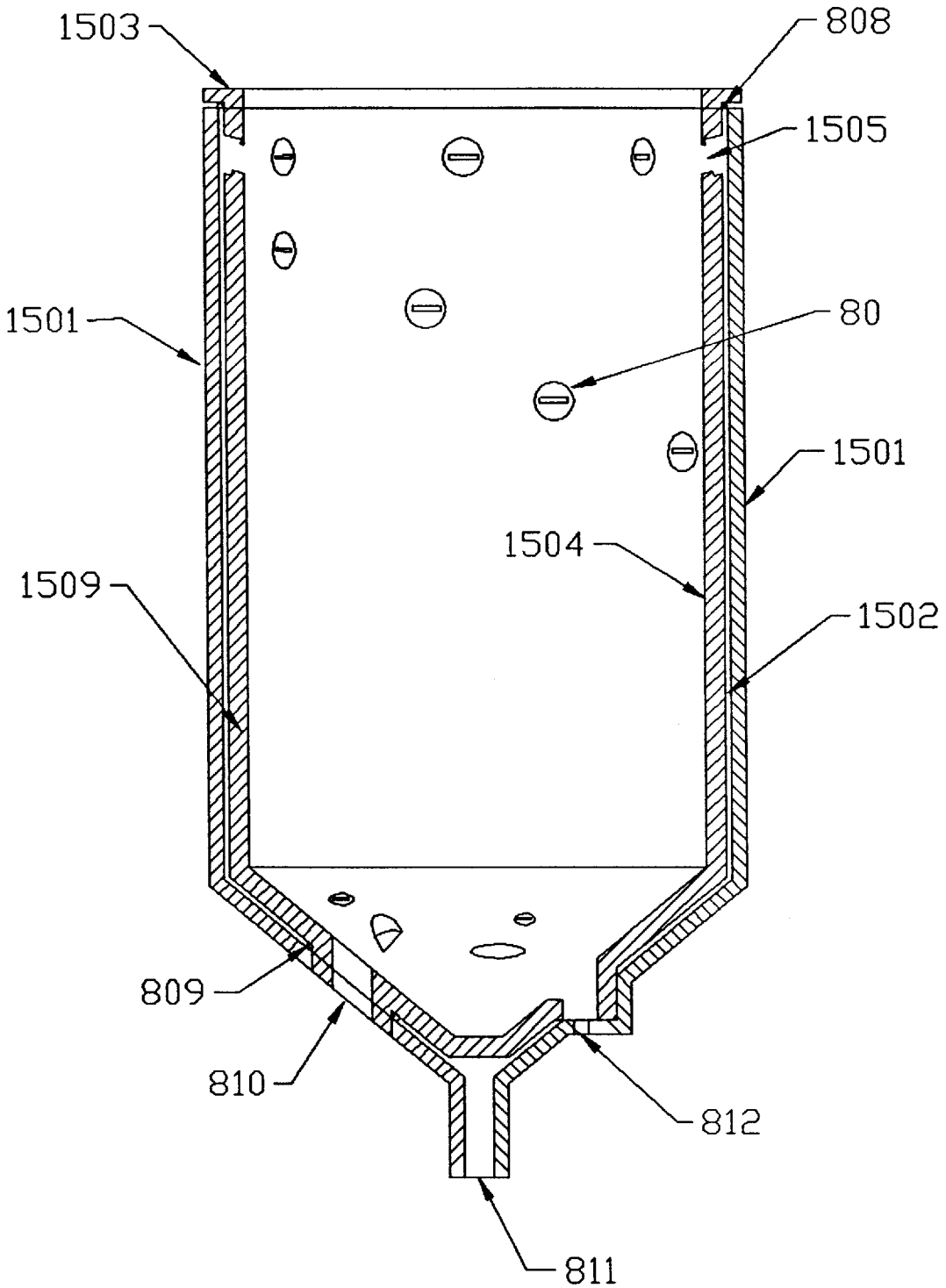
FIG. 15 is a cross sectional view of the preferred embodiment of the inner cylinder.

Referring next to FIG. 15 the outer cylinder 1501 has a water inlet 811 to fill the space 1502. The inner cylinder 1503 has a smooth inner wall 1504. Twenty mounting holes 1505 hold twenty nozzles 80. O-rings 808, 809 contain the water in space 1502. Brass inserts 812 support the inner cylinder 1503 against the outer cylinder 1501. Drain holes 810 function like those shown in the prior art embodiment of FIGS. 1, 2.

Figure 16:
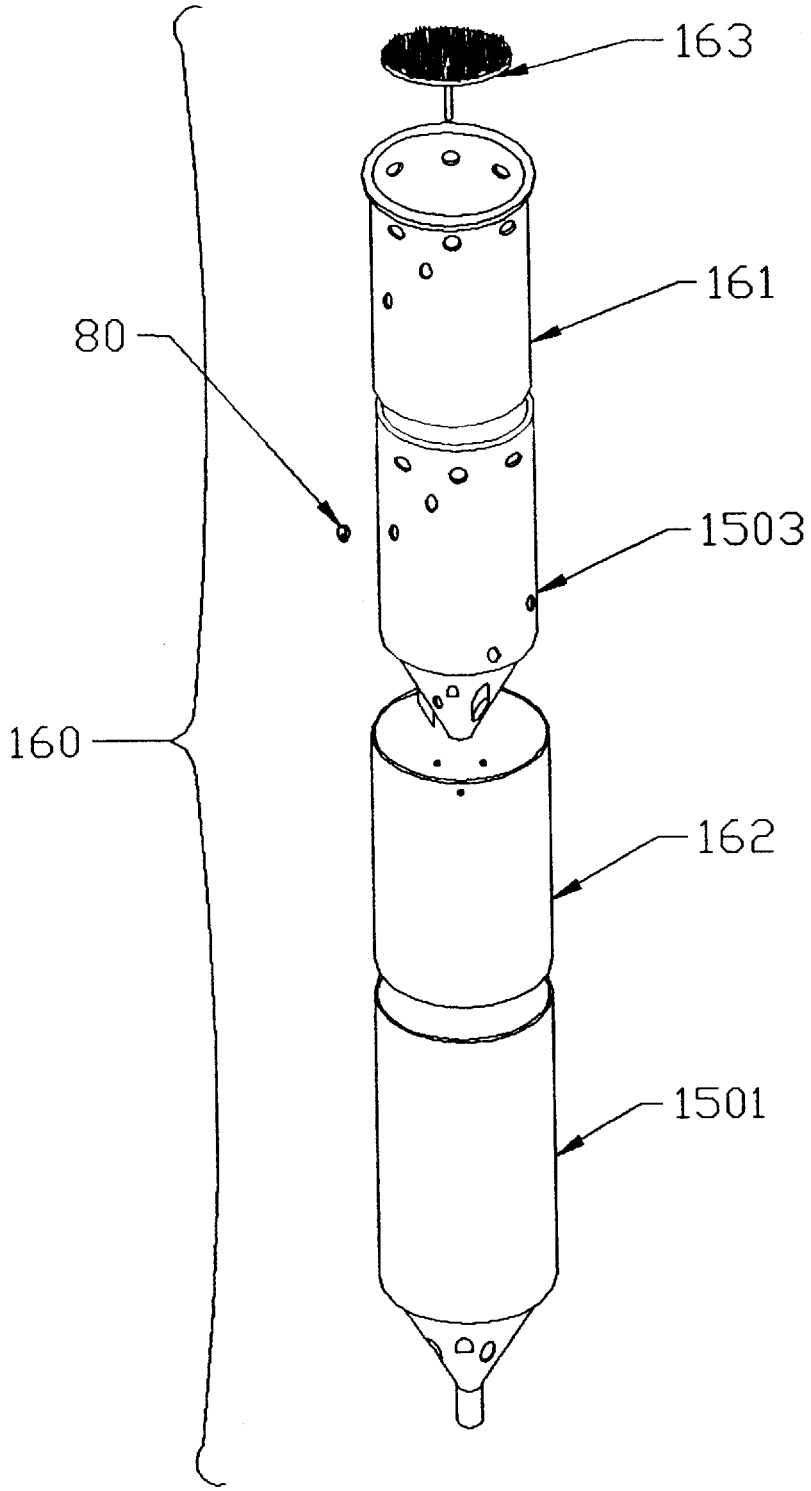
FIG. 16 is an exploded view of an alternate embodiment of the inner cylinder having an optional extension member and a fingernail brush.

Referring next to FIG. 16 an alternate embodiment of the inner cylinder is shown as extended assembly 160. Forearm cleaning is made possible by the lengthening of the inner cylinder with inner cylinder extension 161 and outer cylinder extension 162. An optional fingernail brush 163 has been added to the bottom of the inner cylinder 1503. Extension members 161, 162 are injection molded in one piece each and glued together.

Figure 17:
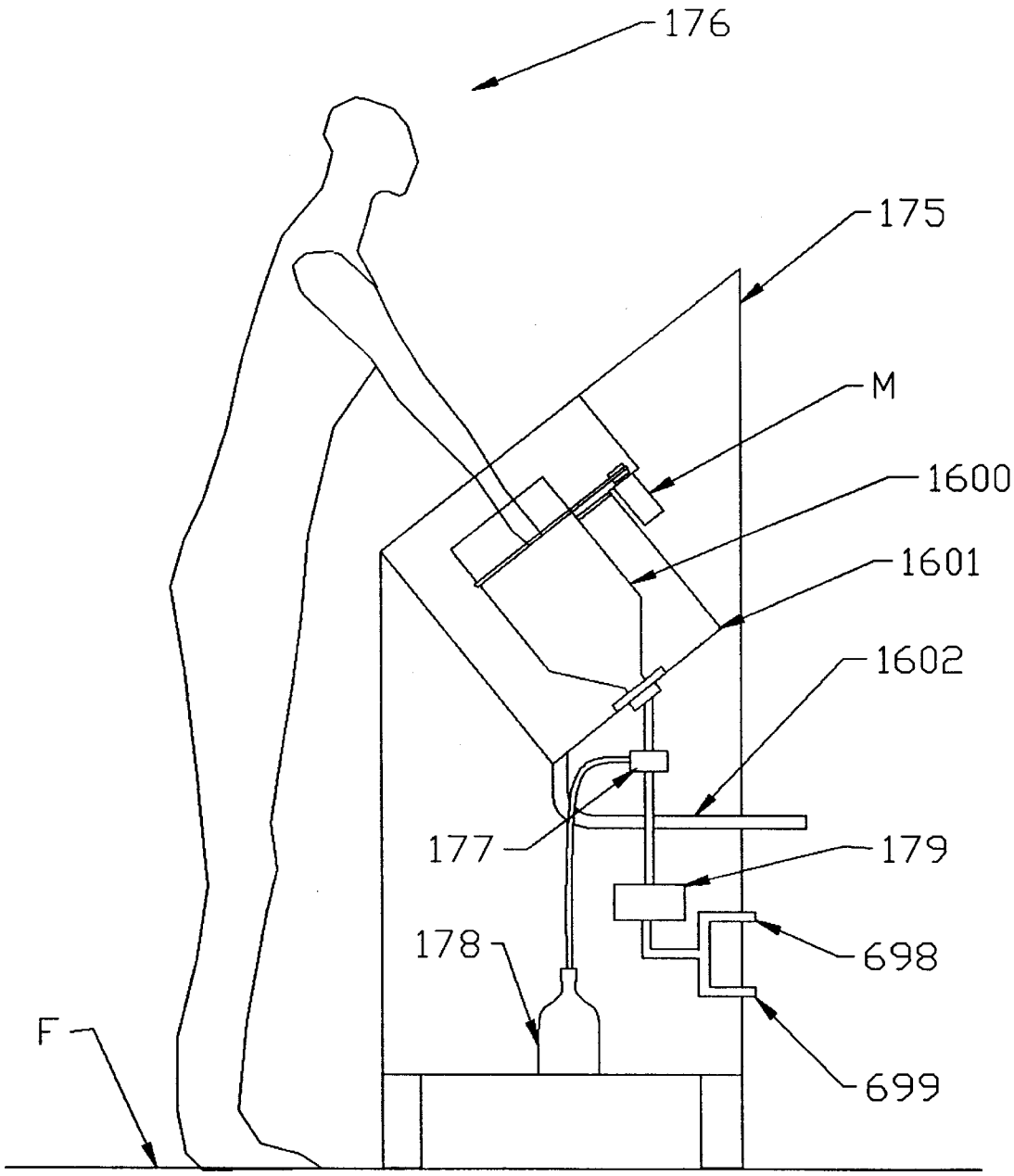
FIG. 17 is a side plan view of a hand/glove washer having the new nozzle and inner cylinder.

Referring next to FIG. 17 a large wash cylinder 160 is shown in use in a hand/glove washer 175. A basin 1601 catches the wash water and drains it out the drain 1602. The user 176 can insert his forearms either gloved or ungloved for no touch washing. Traditional peripherals include the motor M, the chemical injector 177, the soap container 178, the control value 179, and the water inlets 698, 699.

Figure 18:
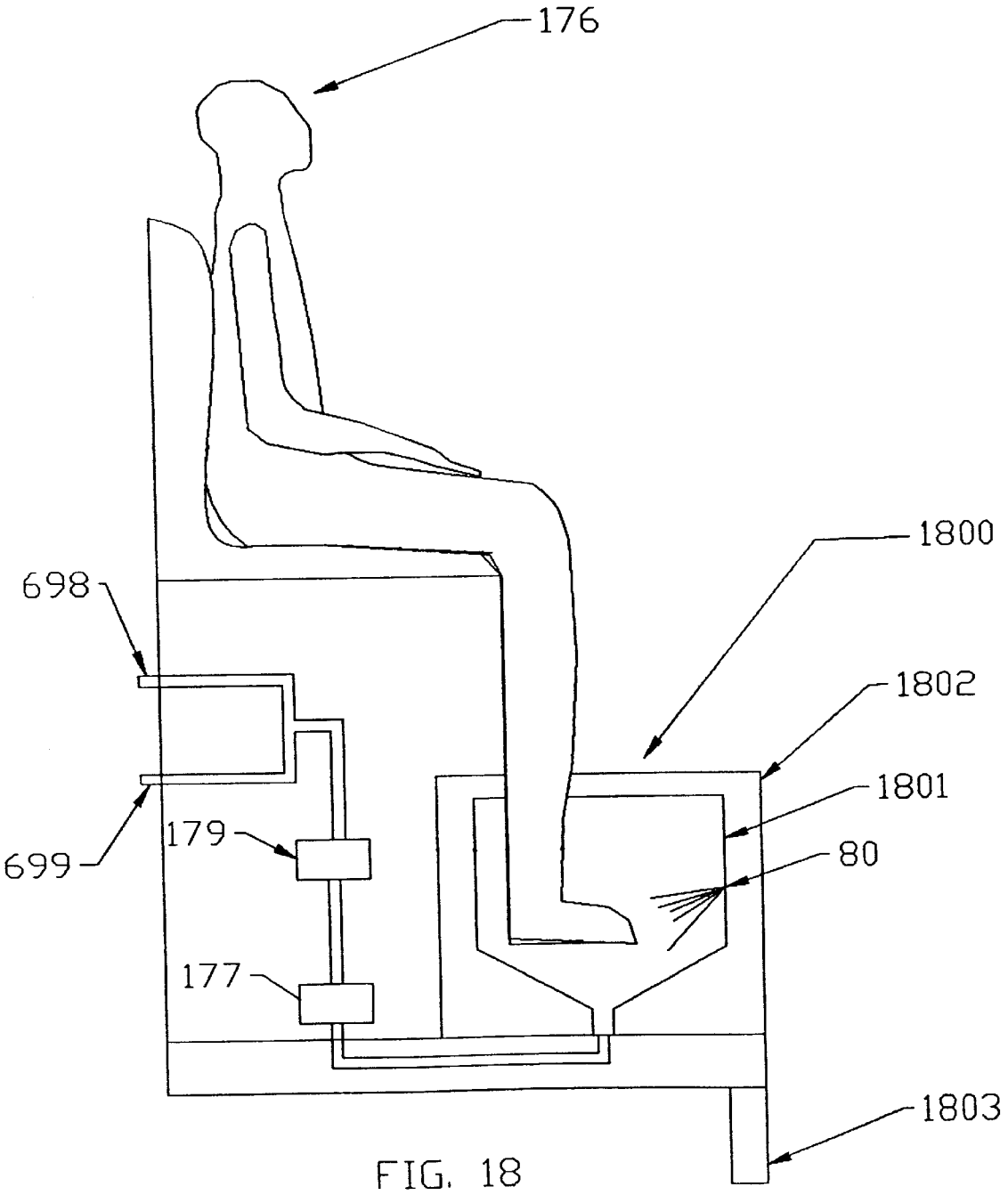
FIG. 18 is a side plan view of a foot washer using the new nozzle and inner cylinder design.

Referring next to FIG. 18 a foot washer 1800 for user 176 has a large wash cylinder 1801 having nozzles 80 and the deflection construction of FIGS. 14, 15. The basin 1802 drains into drain 1803. The novel nozzle 80 and wash cylinder 1802 design makes the unit economically feasible to build.

Figure 19:
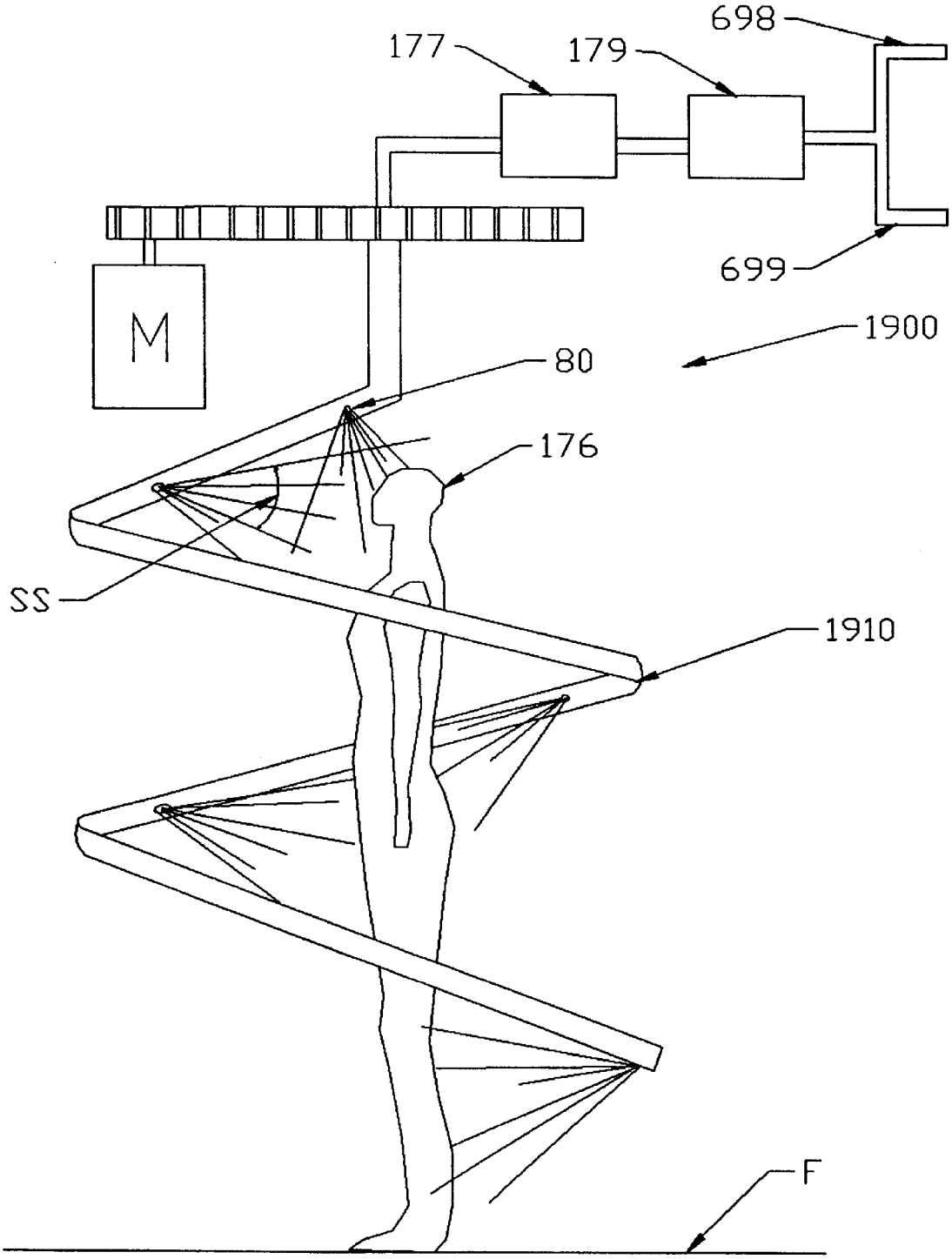
FIG. 19 is a schematic view of a body washer using the new nozzle and inner cylinder design.

Referring next to FIG. 19 a body washer 1900 is shown for user 176. The floor F serves as a drain. A hollow washer tube 1910 is shaped as a helix. The nozzles 80 are mounted to provide a 30° deflection angle for spray pattern SS as taught in FIG. 14. The hollow washer tube can be as thin-walled as ¼ inch due to the deflection of nozzle 80. It rotates like the inner cylinder 1503 of FIG. 15.

Figure 20:
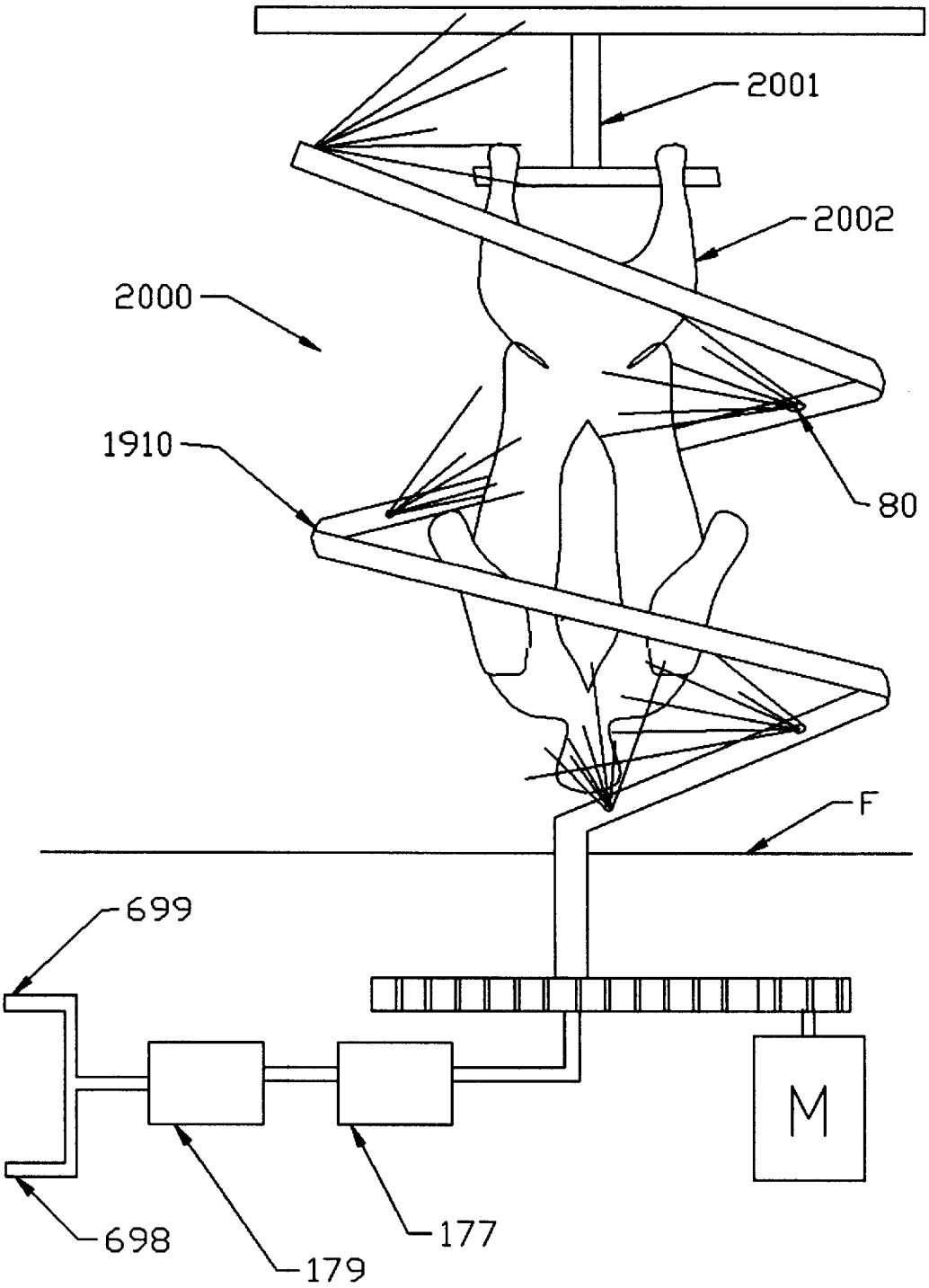
FIG. 20 is a schematic view of a carcass washer having the new nozzle and inner cylinder.

In FIG. 20 the same components 1910, 80, M, 177, 179, 698, 699, and F are installed upside down to provide a carcass washer 2000. The carcass 2002 is lowered by means of the rack 2001 into the wash patterns SS of the nozzles 80.

Figure 21:
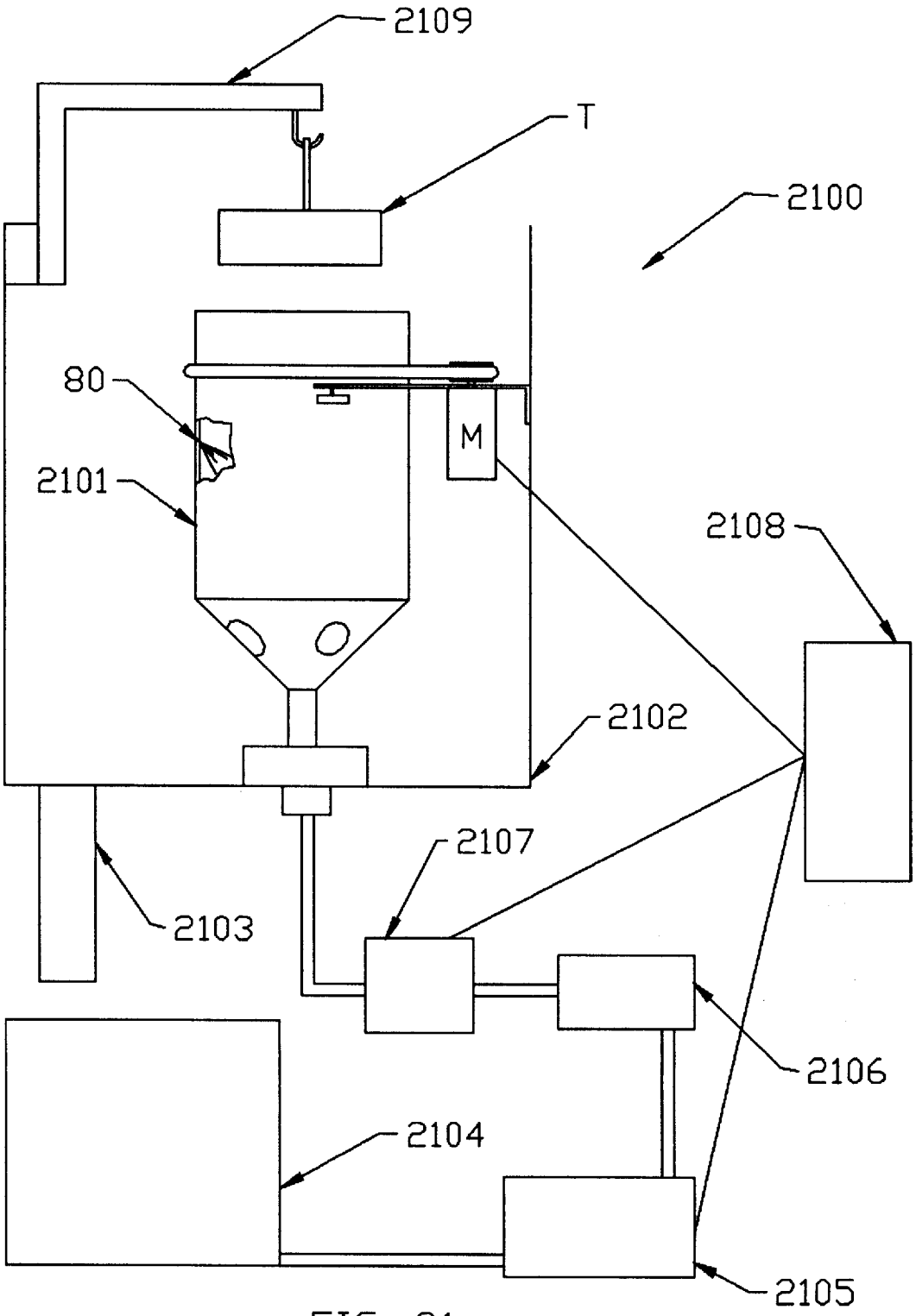
FIG. 21 is a schematic view of a small-parts washer having the new nozzle and inner cylinder.

Referring next to FIG. 21 an industrial small parts washer 2100 is shown having a wash cylinder 2101 having nozzles 80, a basin 2102, a drain 2103, a reservoir 2104, a pump 2105, a filter 2106, a solenoid valve 2107, a crane 2109, a workpiece tray T, a motor M, and a controller 2108.

Figure 22:
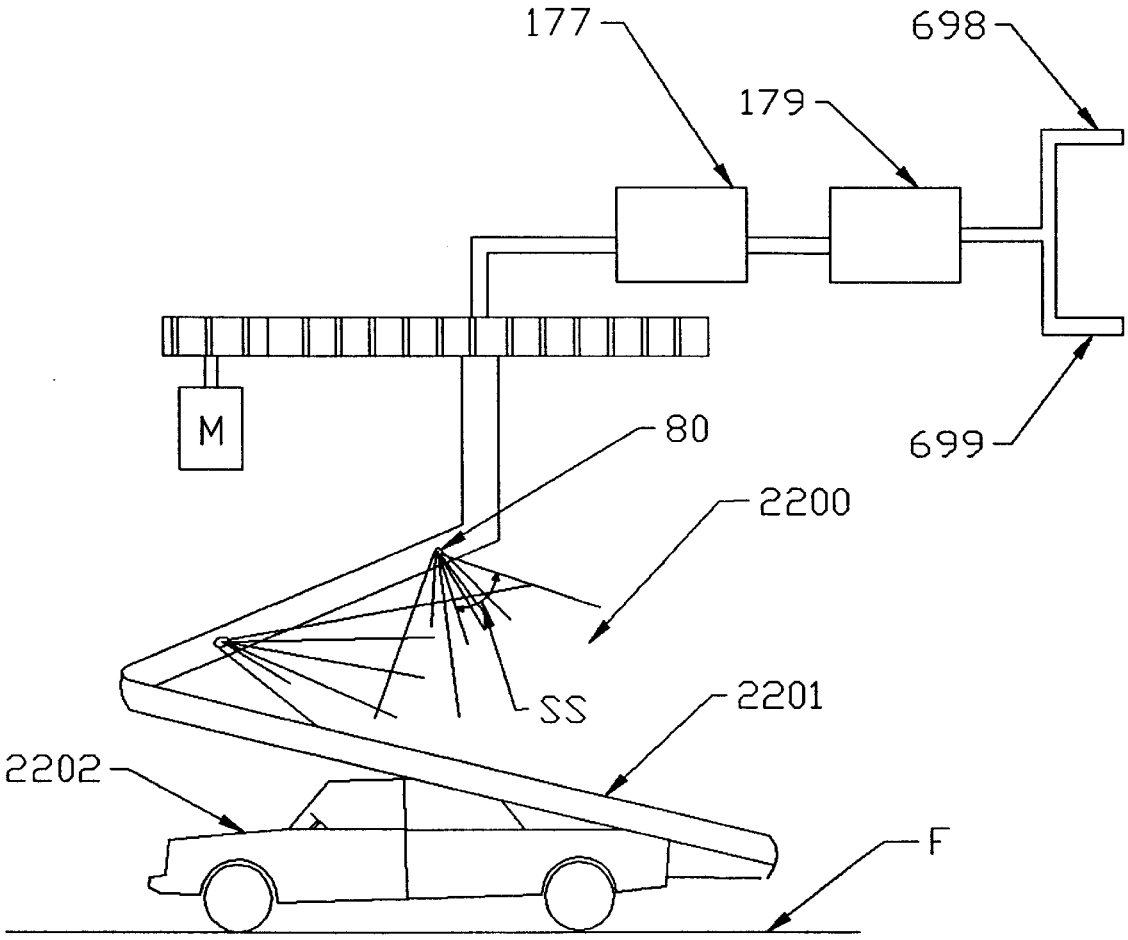
FIG. 22 is a schematic view of a car washer having the new nozzle and inner cylinder.

Referring next to FIG. 22 a car washer 2200 is used to wash a car 2202. Using the teachings of the body washer of FIG. 19, a large diameter helical washer tube 2201 has nozzles 80 which provide a 30° deflected fan pattern SS. The car is driven inside the tube 2201 when the tube 2201 is at rest as shown. Alternatively the tube 2201 could be lowered over the car (not shown).

Figure 23:
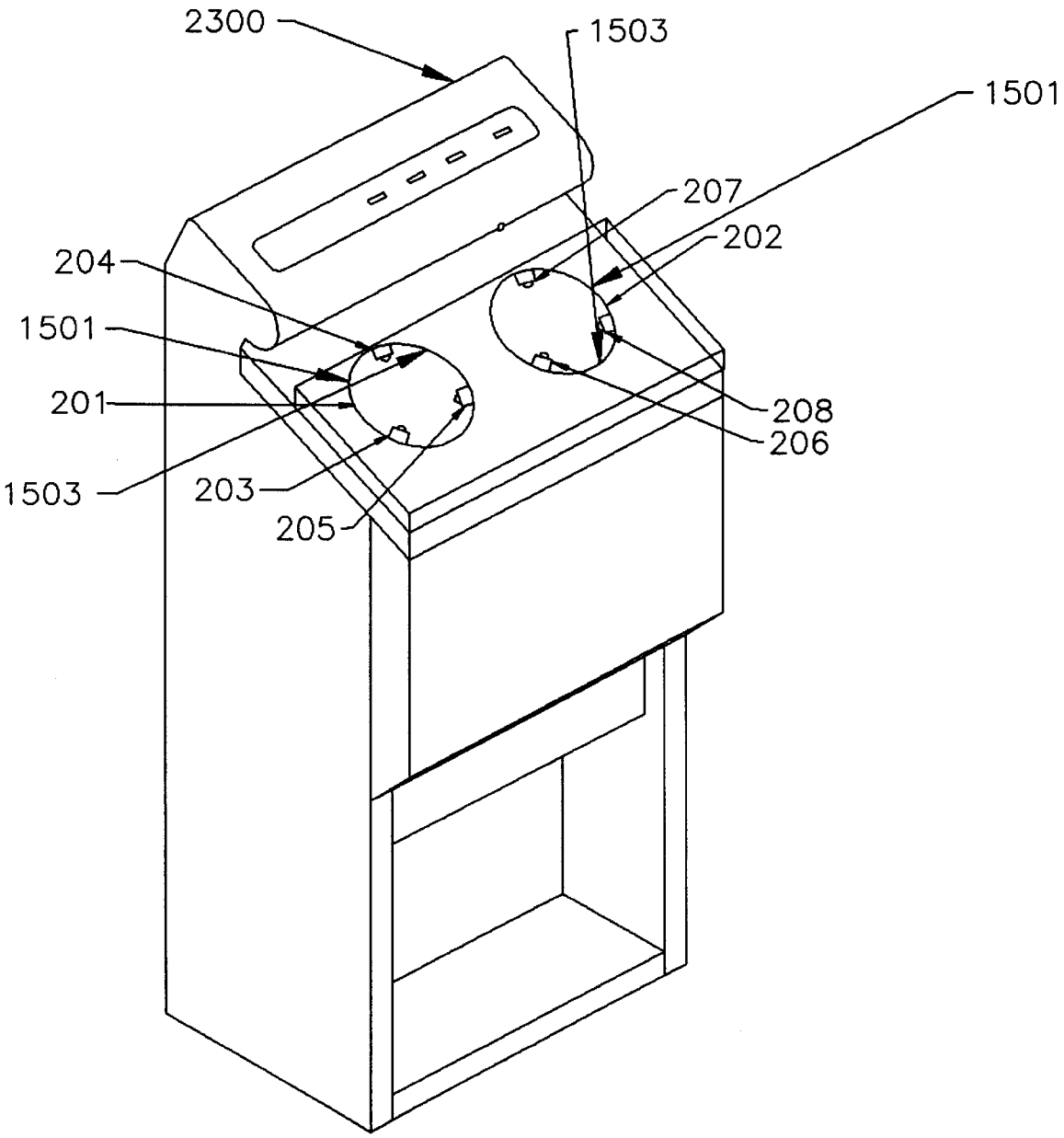
FIG. 23 is a top perspective view of the embodiment of FIG. 17 having optional air knives to dry the user's hands.

Referring last to FIG. 23 optional air knives 203, 204, 205 have been added to the hand washer 2300 around the hand port 201 of the outer and inner cylinders 1501 and 1503 (see FIG. 15). Likewise, air knives 206, 207, 208 have been added to the hand port 202 of inner and outer cylinders 1501 and 1503. The air knives dry the user's hands and minimize water dripping onto the floor.

Although the present invention has been described with reference to preferred embodiments, numerous modifications and variations can be made and still the result will come within the scope of the invention. No limitation with respect to the specific embodiments disclosed herein is intended or should be inferred.

I claim:

1. A nozzle and recess combination comprising:

a retaining wall having a width ($d_1$) and a nozzle mounting recess canted at a first acute angle;

a nozzle having a flat circular base and an inlet surface and an outlet surface;

said inlet surface consisting of an inlet groove starting at a center point and extending through a central groove orifice along a radius of the base to one edge of a perimeter;

said outlet surface having an outlet groove extending through the central groove orifice along a diameter of the base and perpendicular to the inlet groove, whereby a fan pattern is formed at a second acute angle from a normal to the outlet surface;

said nozzle has an orientation which does not extend beyond a front (output) and a rear (input) side of the retaining wall; and said orientation further comprises an alignment of the first and second acute angles such that said first and second angles are cumulative, thereby forming a fan pattern ranging between 15° and 30° from a normal to the front side of the retaining wall.

2. The nozzle of claim 1, wherein the acute angle is 15°.

3. The nozzle of claim 1, wherein the outlet groove is located on a snout attached to the base.

* * * * *